US006028301A

United States Patent [19]

Kim et al.

[11] Patent Number: 6,028,301

[45] Date of Patent: Feb. 22, 2000

[54] METHOD FOR CONTROLLING A MICRO ELECTRO-MECHANICAL SYSTEMS AND VERIFYING THE STATE THEREOF USING LIGHT

[75] Inventors: Kwang Joon Kim; Jong Hyun Lee, both of Daejon, Rep. of Korea

[73] Assignee: Electronics and Telecommunications Research Institute, Daejon, Rep. of Korea

[21] Appl. No.: 08/968,250

[22] Filed: Nov. 12, 1997

[30] Foreign Application Priority Data

Dec. 14, 1996 [KR] Rep. of Korea ..... 96-65754

[51] Int. Cl.[7] ..... H01J 40/14

[52] U.S. Cl. ..... 250/214 LS; 250/214.1; 250/206

[58] Field of Search ..... 250/214 LS, 214.1, 250/214 R, 206

[56] References Cited

U.S. PATENT DOCUMENTS

| | | | |
|---|---|---|---|
| 4,967,068 | 10/1990 | Lentine et al. | 250/214 LS |
| 5,093,565 | 3/1992 | Lentine | 250/214 LS |
| 5,385,632 | 1/1995 | Goossen | 156/630 |

*Primary Examiner*—Que T. Le
*Attorney, Agent, or Firm*—Cohen, Pontani, Lieberman & Pavane

[57] ABSTRACT

The present invention discloses a method for controlling a micro electro-mechanical system manufactured using micro-machining technology and verifying the state thereof and, more particularly, to a method for controlling the micro electro-mechanical system and verifying the state thereof using light so that the voltage applied to each MEMS is determined by the intensity of the light incident on two optical windows of the symmetric SEEDs respectively by attaching the symmetric SEEDs every MEMS to electrically connect one of the SEEDs to the MEMS in parallel, instead of a conventional method in which the voltage from the control circuit is applied directly to the MEMS via wires.

3 Claims, 1 Drawing Sheet

METHOD FOR CONTROLLING A MICRO ELECTRO-MECHANICAL SYSTEMS AND VERIFYING THE STATE THEREOF USING LIGHT

FIELD OF THE INVENTION

The present invention relates to a method for controlling a micro electro-mechanical system (called "MEMS" thereinafter) manufactured using the micro-machining technology and verifying the state thereof and, more particularly, to a method for controlling a micro electro-mechanical system and verifying the state thereof using light so that the voltage applied to each micro electro-mechanical system is determined by the intensity of the light incident on two optical windows of symmetric SEEDs respectively by attaching the symmetric SEEDs every MEMS to electrically connect one of the SEEDs to the MEMS in parallel, instead of a conventional method in which voltage from a control circuit is applied directly to the MEMS via wires.

BACKGROUND OF THE INVENTION

Conventionally various control methods are used to transform the mechanical shape by controlling voltage applied directly from the outside control circuit via wires to induce electrostatic effect or heat.

SUMMARY OF THE INVENTION

The purpose of the present invention is to provide a method for controlling the micro electro-mechanical system and verifying the state thereof using light, in which where the MEMS is adjusted due to variation in the voltage applied by the control technology for the MEMS, if the symmetric SEEDs commonly same size with the MEMS are connected to each other, the mechanical states (positions) of the current MEMS can be observed using light without affecting the state thereof because the light can be used as a control parameter from the outside with to electrically isolate the MEMS from the control circuit, and particularly, in case of the MEMS in which many devices are integrated in a matrix type, the devices can be simultaneously adjusted to form a great number of light matrixes through the method of using a hologram or a direct surface-emission laser matrix etc. without necessitating electrically connecting to each of the devices for control.

It is an object of the present invention to provide a micro-electro mechanical system using the light comprising: a first SEED and a second SEED both of which are serially connected between a power supply and a ground terminal, wherein the second SEED and the micro electro-mechanical system are parallel connected.

It is another object of the present invention to provide a method for controlling a micro-electro mechanical system using light wherein one SEED of the symmetric SEEDs is parallel connected to the micro electro-mechanical system so as to control the intensity of the light incident on each of the symmetric SEEDs to change the voltage applied to the micro electro-mechanical system.

It is further another object of the present invention to provide a method for controlling a micro-electro mechanical system using light and verifying the state thereof wherein the state of the micro electro-mechanical system is verified according to the optical variation in each of the SEEDs which is parallel connected to the micro electro-mechanical system by adjusting the intensity of the light incident on it.

The present invention does supplied the conventional method in which the voltage is directly to each MEMS via wires from the outside control circuit. That is because the conventional method using a direct wire connection has the following several problems;

First, it may cause a problem because the control circuit and the MEMS are not electrically isolated.

Second, an additional apparatus for independently monitoring the mechanical state of the MEMS without affecting it must be devised.

Third, in particular, in case of the MEMS in which many devices are integrated in a matrix type, it is almost impossible to make an electrical connection to each of the devices individually in view of technical aspect and therefore controlling them simultaneously is extremely difficult.

The above-mentioned problems can be easily overcome by the present invention using a wellknown method called a flip-chip-bonding by which the symmetric SEEDs each having almost same size with the device are connected to each device.

BRIEF DESCRIPTION OF THE DRAWINGS

For fuller understanding of the nature and object of the invention, reference should be had to the following detailed description taken in conjunction with the accompanying drawings in which.

Similar reference characters refer to similar parts in the several views of the drawings.

DESCRIPTION OF THE INVENTION

Self Electro-Optical Effect Device ("SEED") is consisted of a P-I-N diode structure on top and bottom of which the electrodes are installed respectively so that they could apply a high electric field to multiple quantum wells composed of compound semiconductor etc. The symmetric SEED has a structure in which two SEEDs of same type are electrically connected to each other serially and it is usually designed to apply a reverse voltage thereto.

Figure 1:
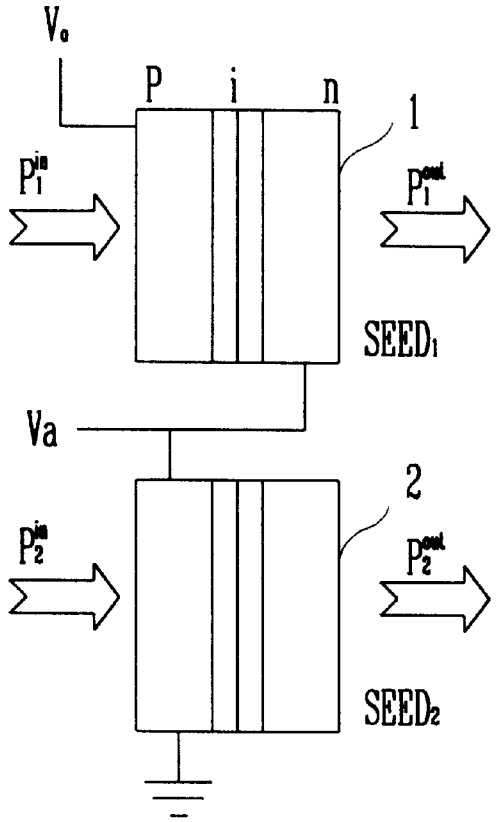
FIG. 1 illustrates a basic structure of the symmetric SEEDs.

FIG. 1 illustrates a basic structure of the symmetric SEEDs.

An exciton absorption peak generated by the multiple quantum-wells moves toward the wavelength with increase of the intensity of the electric field applied from the outside. Therefore, the absorption at the wavelength of the exciton absorption peak without external electricfield is decreased with increase of the intensity of the applied electric field.

If strong and weak lights each are incident on the two symmetric SEEDs respectively, the photocurrent of the symmetric SEED on which a strong light is incident is greater than that of the symmetric SEED on which a weak light is incident. Since the total voltage is constant, if a relatively great voltage is applied to the symmetric SEED on which a weak light is incident, the absorption rate at the symmetric SEED on which a strong light is incident is more great, resulting in a positive feedback. As a result, an optical bistability depending on the relative amount of the incident light appear. In other words, two possible ground-states appears. At this time, the ground-states may be classified into two cases; (1) almost all the voltages are applied to a first SEED 1 and (2) almost all the voltages are applied to a second SEED 2.

In general, two symmetric SEEDs are same in size. This, however,is not a necessary condition. If the first SEED 1 and the second SEED 2 shown in FIG. 1 are same in size, since the condition necessary to move from one ground-state to another ground-state in the symmetric SEEDs is same with the condition necessary to move them in opposite direction, the SEEDs having same size are usually used.

Figure 2:
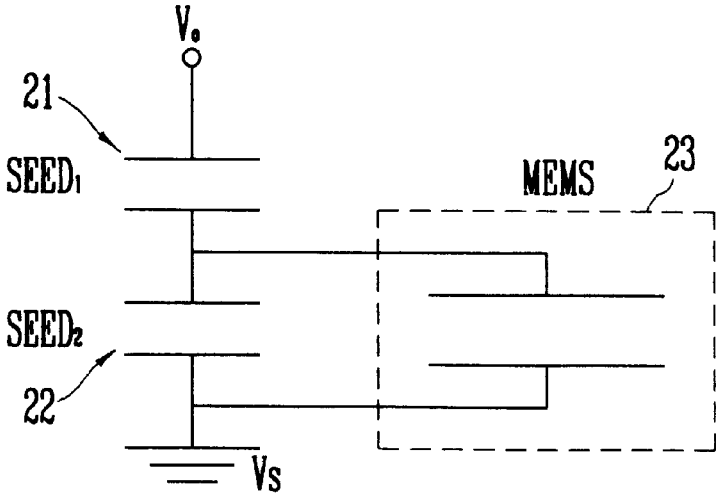
FIG. 2 illustrates a structure in which the symmetric SEEDs and the micro electro-mechanical system are connected.

FIG. 2 is an electrical circuit diagram showing the symmetric SEEDs and a micro electro-mechanical system.

In the drawing, a first SEED 21 and a second SEED 22 are serially connected between the power supply Vo and the ground terminal Vs, and the second SEED 22 and the MEMS 23 are parallel connected.

As shown in the drawing, when they are made an electrical connection, the voltage applied to the MEMS can be regulated by controlling the amount of the light incident on each of the SEEDs and the state of the MEMS can be known by means of the light absorption rate of the SEEDs. The SEEDs are mainly manufactured by compound semiconductors. Though many MEMS are manufactured using silicon as a substrate,to connect them electrically using technology such as flip-chip-bonding etc. is common.

The micro electro-mechanical system using light according to the preset invention is electrically isolated from the circuit for controlling the MEMS and the MEMS itself, and it can be adjusted only by the light. In addition, since the voltage actually applied can be known directly by observing the degree in which the light is absorbed, the effect in which the mechanical movement of the MEMS can be observed in real-time can be obtained, and depending on the case, information obtained through this observation is feedbacked to the control circuit for an efficient control.

This type of symmetric SEEDs are about tens of $_{\mu}$m in size having a similar size with the MEMS and may be mounted onto the MEMS by means of the flip-chip-bonding.

In addition, the major advantages of this method is that many MEMSs formed in a matrix type can be driven by means of the matrix of the lights simultaneously. The circuit for controlling the MEMS and the MEMS itself are electrically isolated from each other and adjusted only by the light. Also, since the voltage actually applied can be known directly by observing the degree in which the light is absorbed, the effect in which the mechanical movement of the MEMS can be observed in real-time can be obtained, and depending on the case, information obtained through this observation can be feedbacked to the control circuit for an efficient control.

The present invention relates to a method for controlling a micro electro-mechanical system manufactured by a micro-machining technology and verifying the state thereof in which the circuit for controlling the MEMS and the MEMS itself is electrically isolated from each other. And the MEMS is also adjusted only by the light so that the voltage applied to each MEMS is determined by the intensity of the light incident on two optical windows of the symmetric SEEDs respectively by attaching the symmetric SEEDs every MEMS to electrically connect one of the SEEDs to the MEMS, instead of a conventional method in which the voltage from a control circuit is applied directly to the micro electro-mechanical systems via wires.

Since the voltage actually applied can be known directly by observing the degree in which the light is absorbed, the effect in which the mechanical movement of the MEMS can be observed in real-time can be obtained, and depending on the case, information obtained through this observation can be feedbacked to the control circuit for an efficient control.

This type of symmetric SEEDs are about tens of m in size having a similar size with the MEMS and can be also mounted onto the MEMS by means of the flip-chip-bonding.

The foregoing description, although described in its preferred embodiment with a certain degree of particularity, is only illustrative of the principles of the present invention. It is to be understood that the present invention is not to be limited to the preferred embodiments disclosed and illustrated herein. Accordingly, all expedient variations that may be made within the scope and spirit of the present invention are to be encompassed as further embodiments of the present invention.

What is claimed is:

1. A controller for a micro-electro mechanical system using light comprising:

two self electro-optical effect devices connected in series between a power supply and a ground terminal, wherein one of said self electro-optical effect devices is connected in parallel to the micro-electro mechanical system.

2. A method for controlling a micro-electromechanical system using light comprising the step of varying a voltage applied to the micro electro-mechanical system by adjusting an intensity of light incident on each of symmetric self electro-optical effect devices, wherein one self electro-optical effect device of the symmetric self electro-optical effect devices is connected in parallel to the micro electro-mechanical system.

3. A method for monitoring a micro electro-mechanical system using light comprising the step of verifying a state of the micro electro-mechanical system based on an optical variation in each of two self electro-optical effect devices, one of which is connected in parallel to the micro electro-mechanical system.

* * * * *